US006035453A

United States Patent [19]

Cain

[11] Patent Number: 6,035,453

[45] Date of Patent: Mar. 14, 2000

[54] RACE CAR DRIVER VEST

[75] Inventor: Mark Dale Cain, 303 S. Mississippi, Atoka, Okla. 74525

[73] Assignee: Mark Dale Cain, Atoka, Okla.

[21] Appl. No.: 09/146,150

[22] Filed: Sep. 3, 1998

[51] Int. Cl.[7] ..... A41D 13/00

[52] U.S. Cl. ..... 2/462; 2/44; 2/102

[58] Field of Search ..... 2/463, 462, 102, 2/94, 44, 455, 456

[56] References Cited

U.S. PATENT DOCUMENTS

| | | |
|---|---|---|
| D. 340,542 | 10/1993 | Marlowe . |
| 4,425,667 | 1/1984 | Harrison . |
| 4,602,385 | 7/1986 | Warren . |
| 5,465,423 | 11/1995 | Taylor-Varney . |

*Primary Examiner*—Gloria M. Hale
*Assistant Examiner*—Tejash Patel
*Attorney, Agent, or Firm*—Dunlap, Codding & Rogers, P.C.

[57] ABSTRACT

A vest adapted to be worn by an individual, such as a race car driver. The vest includes a cushioning assembly. The cushioning assembly is adapted to extend about the chest cavity, collar bones, sternum, shoulder blades, clavicles and rib area of the individual to prevent injury to the individual when impact is applied thereto. The cushioning assembly is also constructed to permit air to circulate about and cool the portions of the individual covered by the cushioning assembly. The cushioning assembly typically extends downwardly from about the hollow of the throat of individual to near the midriff of the individual whereby the individual can assume a seated position in a seat, such as a molded race car seat without substantial interference from the cushioning assembly.

13 Claims, 6 Drawing Sheets

RACE CAR DRIVER VEST

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The injuries of race car drivers during races are well known in the art. Many types of safety apparatus have been designed to protect the race car driver so that injuries to the race car driver are minimized during crashes. For example, seat belt straps extending across the shoulders, and waist of the race car driver are currently in use to protect the race car driver from injury. In addition, race car seats are molded to be disposed about the trunk of the race car driver when the race car driver assumes a seated position to prevent lateral movement of the race car driver.

During a frontal impact of the race car with another race car, the prior art seat belt straps, and molded seats may function to sufficiently protect the race car driver.

However, if the race car hits a wall or other substantially immoveable object the race car driver can be ejected from the seat with such force that the seat belts overlying the race car driver's shoulder blades can break the race car driver's collar bones and/or rib cage. During a side impact, the race car driver is thrown toward or away from the race car's door. The lateral force placed on the race car driver during a side impact can cause the seat belts and/or the molded car seat to break the race car driver's shoulder blades, clavicles and/or collar bones.

To protect themselves against such injuries, race car drivers have worn football pads, such as rib pads, knee pads, shoulder pads and hip pads. In addition, such race car drivers have also worn bull riding vests to protect themselves. The comfort of the protective devices worn by the race car driver is an extremely important consideration because of the heat build up within a race car. The football pads and the bull riding vest have typically not functioned adequately to protect the race car driver from injury, and also may make the race car driver uncomfortable during the race. For example, the bull riding vest did not cover and protect the shoulder blades entirely thereby leading to injury in the event there is a car crash. In addition, such football pads and bull riding vests were generally inflexible and retained heat thereby preventing the race car driver from sitting comfortably in the seat of the race car. Moreover, the bull riding vest had a lower portion which extended over the tail bone of the individual thereby making the race car driver even more uncomfortable.

Due to the uncomfortable nature of the football pads and bull riding vest, some race car drivers elected not to wear these protective devices even though these devices did afford some protection. Thus, there is a need for a vest which more adequately protects the race car driver while also being more comfortable for the race car driver to wear during races. It is to such a novel vest that the present invention is directed.

SUMMARY OF THE INVENTION

Broadly, the present invention relates to improvements in vests adapted to be worn by an individual, such as a race car driver. The vest includes a cushioning assembly. The cushioning assembly is adapted to extend about the chest cavity, collar bones, sternum, shoulder blades, clavicles and rib area of the individual to prevent injury to the individual when impact is applied thereto. The cushioning assembly is also constructed to permit air to circulate about and cool the portions of the individual covered by the cushioning assembly. The cushioning assembly typically extends downwardly from about the hollow of the throat of the individual to near the midriff of the individual whereby the individual can assume a seated position in a seat, such as a molded race car seat without substantial interference from the cushioning assembly.

In one aspect, the vest is provided without portions extending below the midriff of the individual, so that when the individual assumes the seated position, the cushion assembly does not engage the legs or the tail bone of the individual.

These and other aspects of the invention will be more fully understood by referring to the following detailed description and accompanying drawings.

DETAILED DESCRIPTION OF THE INVENTION

Figure 1:
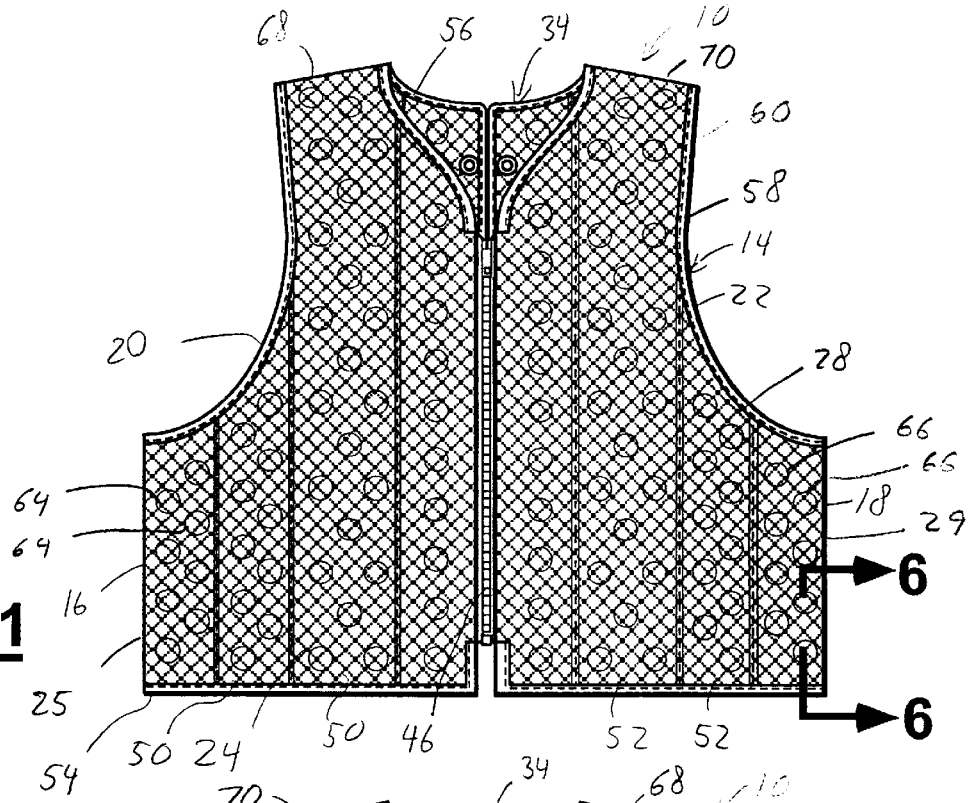
FIG. 1 is a front elevational view of a vest constructed in accordance with the present invention.
Figure 3:
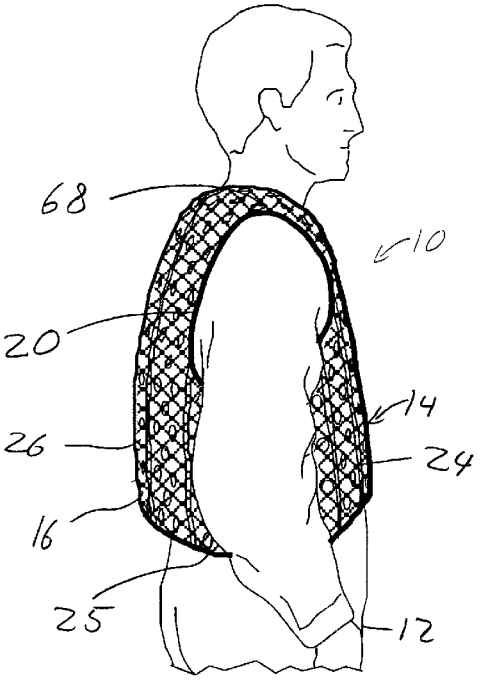
FIG. 3 is a side elevational view of the vest depicted in FIGS. 1 and 2 with the vest being worn by an individual.
Figure 4:
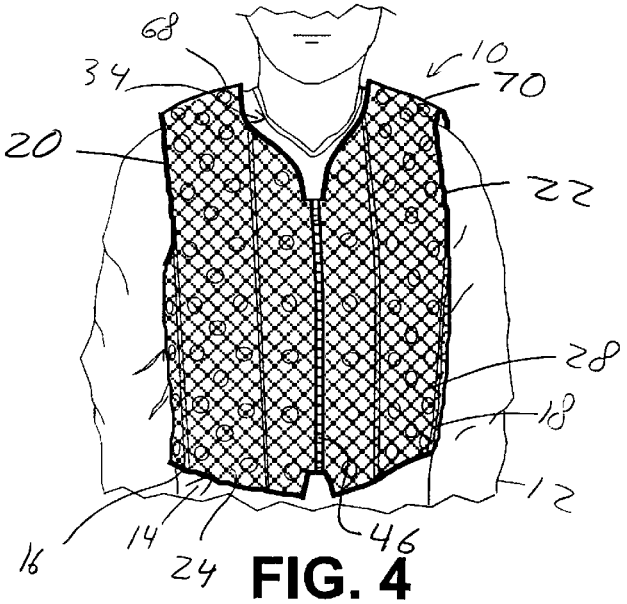
FIG. 4 is a front elevational view of the vest depicted in FIGS. 1–3 illustrating the vest being worn by the individual.
Figure 5:
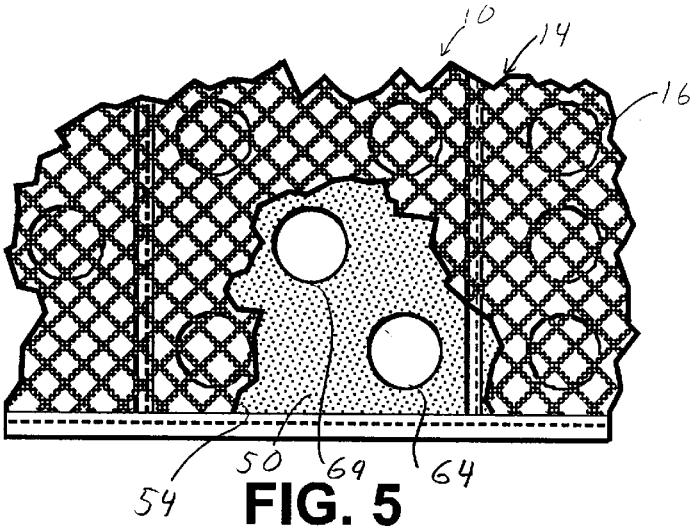
FIG. 5 is a fragmental, partial cut away view illustrating a portion of a cushioning member disposed within an outer shell.
Figure 6:
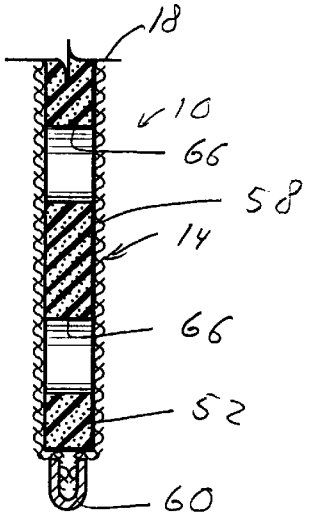
FIG. 6 is a fragmental, cross-sectional view of a portion of the vest, taken along the lines 6—6 depicted in FIG. 1.
Figure 7:
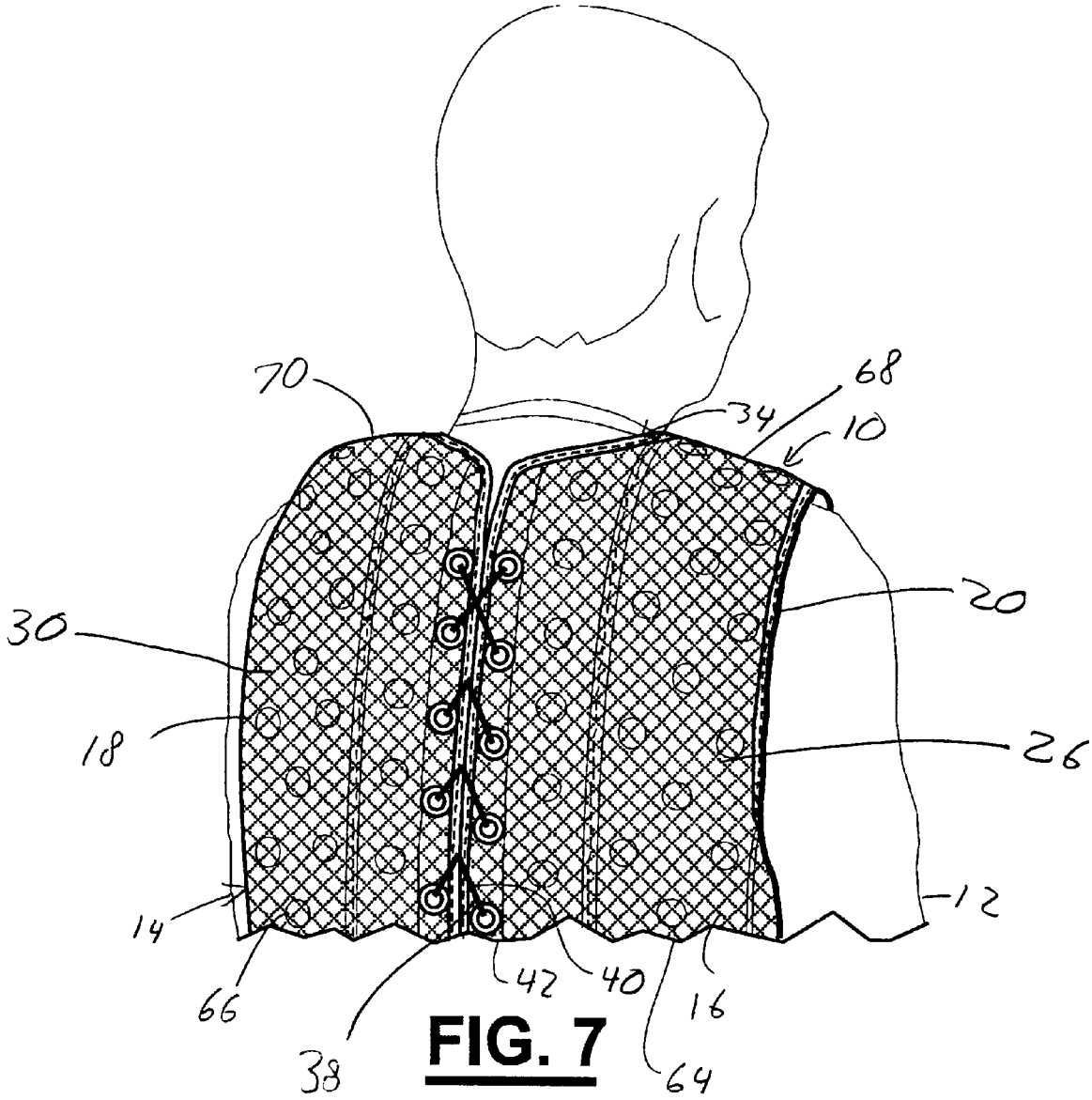
FIG. 7 is partial, rear perspective view of the vest depicted in FIGS. 1–6 being worn by the individual.

Referring now to the drawings, and more particularly to FIG. 1, shown therein is a vest 10 constructed in accordance with the present invention. The vest 10 is adapted to he worn about at least a portion of the trunk of an individual 12 (FIGS. 3, 4 and 7). The vest 10 is provided with a cushioning assembly 14. The cushioning assembly 14 is adapted to extend about and substantially cover the chest cavity, collar bones, sternum, shoulder blades, clavicles and rib area of the individual 12 to prevent injury to the individual 12 when impact is applied to the cushioning assembly 14. The cushioning assembly 14 is also constructed to permit air to circulate about and cool the portions of the individual 12 covered by the cushioning assembly 14. The cushioning assembly 14 extends downwardly from about a hollow of the throat of the individual 12 to near the midriff of the individual 12 whereby the individual 12 can assume a seated position without substantial interference from the cushioning assembly 14.

The chest cavity, collar bones, sternum, shoulder blades, clavicles, rib area, hollow of the throat, and midriff are all portions of the body of the individual 12, and their location on the individual 12 is well known in the art. Thus, no further comments are deemed necessary to teach one of ordinary skill in the art the location of the chest cavity, collar bones, sternum, shoulder blades, clavicles, rib area, hollow of the throat, and the midriff of the individual 12.

As shown in FIG. 1, the cushioning assembly 14 of the vest 10 includes a first side vest member 16, and a second side vest member 18. Openings 20 and 22 are provided in the respective first side vest member 16, and the second side vest member 18. The openings 20 and 22 are sized and dimensioned to receive respective arms of the individual 12 therethrough, as illustrated in FIGS. 3 and 4.

The first side vest member 16 is provided with a frontal portion 24, a side portion 25 and a rear portion 26. The second side vest member 18 is provided with a frontal portion 28, a side portion 29, and a rear portion 30. The first side vest member 16 and the second side vest member 18 cooperate to define a neck receiving opening 34, which is sized and dimensioned to receive the neck of the individual 12, as shown in FIGS. 3, 4, and 7.

Figure 2:
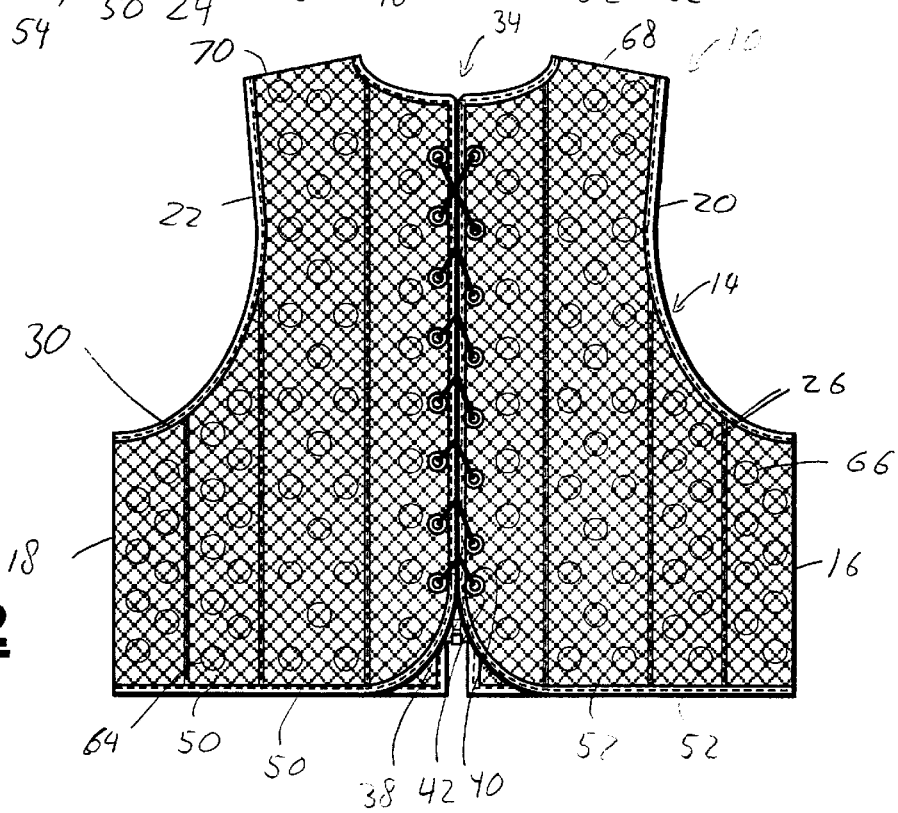
FIG. 2 is a rear elevational view of the vest depicted in FIG. 1.

A first connector assembly 38 (FIGS. 2 and 7) is provided for connecting the rear portion 26 of the first side vest member 16 to the rear portion 30 of the second side vest member 18. As shown in FIG. 2, the first connector assembly 38 can be laces 40 threaded through openings 42 provided in the first and second side vest members 16 and 18, as shown in FIG. 2. Only one of the openings 42 are labeled in FIG. 2 for purposes of clarity.

A second connector assembly 46 (FIGS. 1 and 4) is provided for selectively connecting the frontal portions 24 and 28 of the first and second side vest members 16 and 18, respectively. As shown in FIG. 1, the second connector assembly 46 can be a zipper extending in between the first and second side vest members 16 and 18.

The first side vest member 16 is provided with a plurality of contiguously and spatially disposed vertical cushioning members 50. Only two cushioning members 50 are labeled in FIGS. 1 and 2 for purposes of clarity. The second side vest member 18 is also provided with a plurality of contiguously and spatially disposed vertical cushioning members 52. Only two of the cushioning members 52 are labeled in FIGS. 1 and 2 for purposes of clarity. The first side vest member 16 is provided with an outer shell 54 disposed about the cushioning members 50 to substantially encompass the cushioning members 50. The outer shell 54 can be constructed of a mesh-like material having a plurality of openings formed therethrough to permit air to circulate through the outer shell 54. To maintain each of the cushioning members 50 in the contiguously disposed position, stitching 56 can be provided through adjacently disposed portions of the outer shell 54 about the perimeter of the vest 10, and in between the cushioning members 50.

The second side vest member 18 is provided with an outer shell 58 encompassing the cushioning members 52, substantially as shown. The outer shell 58 can be constructed of a mesh-like material having a plurality of spatially disposed openings formed therethrough to permit air to circulate through the outer shell 58. To maintain the cushioning members 52 in the contiguously disposed position, stitching 60 can be provided through adjacently disposed portions of the outer shell 58, and generally in between each of the contiguously disposed cushioning members 52.

To help cool the individual 12, the cushioning members 50 and 52 are provided with a plurality of openings 64 and 66 to receive air there through so that air can pass through the openings formed in the outer shells 54 and 58 and through the openings 64 and 66 to circulate about and cool the portions of the individual 12 covered by the cushioning members 50 and 52 of the vest 10.

To enhance the comfort of the individual 12, the cushioning members 50 and 52 are formed of a flexible, yet resilient material so as to be comfortable when worn by the individual 12, yet capable of preventing or reducing injury to the individual 12 when impact is applied thereto. In one embodiment, the cushioning members 50 and 52 can be constructed of a closed cell crosslinked Medium Density Polyethylene foam (MDPE), such as Voltek M-380.

The frontal portions 24 and 28 of the first and second side vest members 16 and 18 extend downwardly from near the hollow of the individual's throat to near the individual's midriff so as to cover the individual's chest region. The side portions 25 and 29 of the first and second side vest members 16 and 13 cover the upper torso below the arms of the individual 12 so as to protect the individual 12 from lateral impact with the molded car seat when a side collision occurs, for example. The rear portions 26 and 30 of the first and second side vest members 16 and 18 are shaped and sized so as to extend over and cover the shoulder blade regions of the individual 12, without covering the tail bone region of the individual 12 whereby the individual 12 can assume a seated position in a seat of a race car, for example, without substantial interference from the rear portions 26 and 30 so that the individual 12 will be more comfortable in the seated position. The first and second side vest members 16 and 18 are provided with respective upper shoulder portions 68 and 70. The upper shoulder portions 68 and 70 are sized and shaped so as to cover the right and left shoulders of the individual 12 so as to protect the collar bone, shoulder blades, and clavicle regions of the individual 12 from injury when impact is applied thereto. The upper shoulder portions 68 and 70 can be shaped and sized (as shown in FIGS. 3 and 4) to prevent injury to the collar bone, shoulder blades, clavicle regions of the individual 12 resulting from impact thereto from respective seat belt straps (not shown) extending over the upper shoulder portions 68 and 70.

In use, the individual 12 places the individual's arms through the openings 20 and 22 in the respective first side vest member 16, and the second side vest member 18. The second connector assembly 46 is then manipulated to connect the frontal portions 24 and 28 of the first and second side vest members 16 and 18, respectively. The first connector assembly 38 is then adjusted to control the distance between the rear portion 26 of the first side vest member 16 and the rear portion 30 of the second side vest member 18 so that the vest 10 is disposed snugly about the individual's torso.

In this position, the cushioning assembly 14 functions to prevent or reduce injury to the individual 12 from impact applied to the cushioning assembly 14. In the instance when the vest 10 is to be utilized as a race car driver vest, the individual 12 then sits in the seat of the race car, and the seat belts and other safety harnesses are disposed snugly about the individual 12.

The Embodiments of FIGS. 8–12

Shown in FIGS. 8–12 and designated by the general reference numeral 100 is a vest, which is constructed in accordance with the present invention. The vest 100 is sized, dimensioned and adapted to be worn about at least a portion of the trunk of an individual, such as the individual 12 depicted in FIGS. 3, 4 and 7. The vest 100 is provided with a cushioning assembly 102. The cushioning assembly 102 is adapted to extend about and substantially cover the chest cavity, collar bones, sternum, shoulder blades, clavicles and rib area of the individual to prevent injury to the individual when impact is applied to the cushioning assembly 102. The cushioning assembly 102 is also constructed to permit air to circulate about and cool the portions of the individual covered by the cushioning assembly 102. The cushioning assembly 102 extends downwardly from about a hollow of the throat of the individual 12 to near the midriff of the individual in the front, and from the nape of the neck of the individual to just below the individual's shoulder blades in the back whereby the individual can assume a seated position without substantial interference from the cushioning assembly 102.

Figure 8:
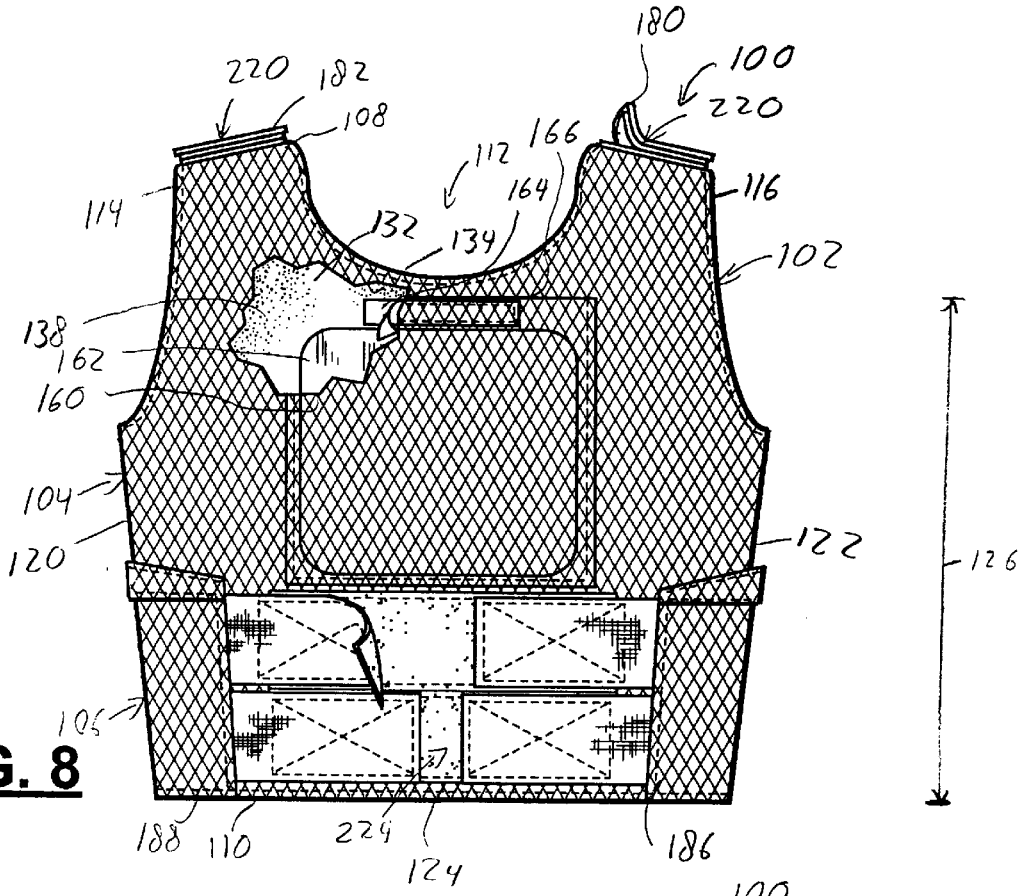
FIG. 8 is a front elevational view of a second embodiment of a vest constructed in accordance with the present invention wherein the vest has a portion of an outer shell removed to illustrate a front cushioning member, and a resilient, rigid support member disposed on the outside of the front cushioning member wherein the support member is positioned to protect the individual's chest from a frontal impact with a steering wheel, for example.

As shown in FIG. 8, the cushioning assembly 102 of the vest 100 includes a frontal cushioning assembly 104, and a rear cushioning assembly 106.

Figure 10:
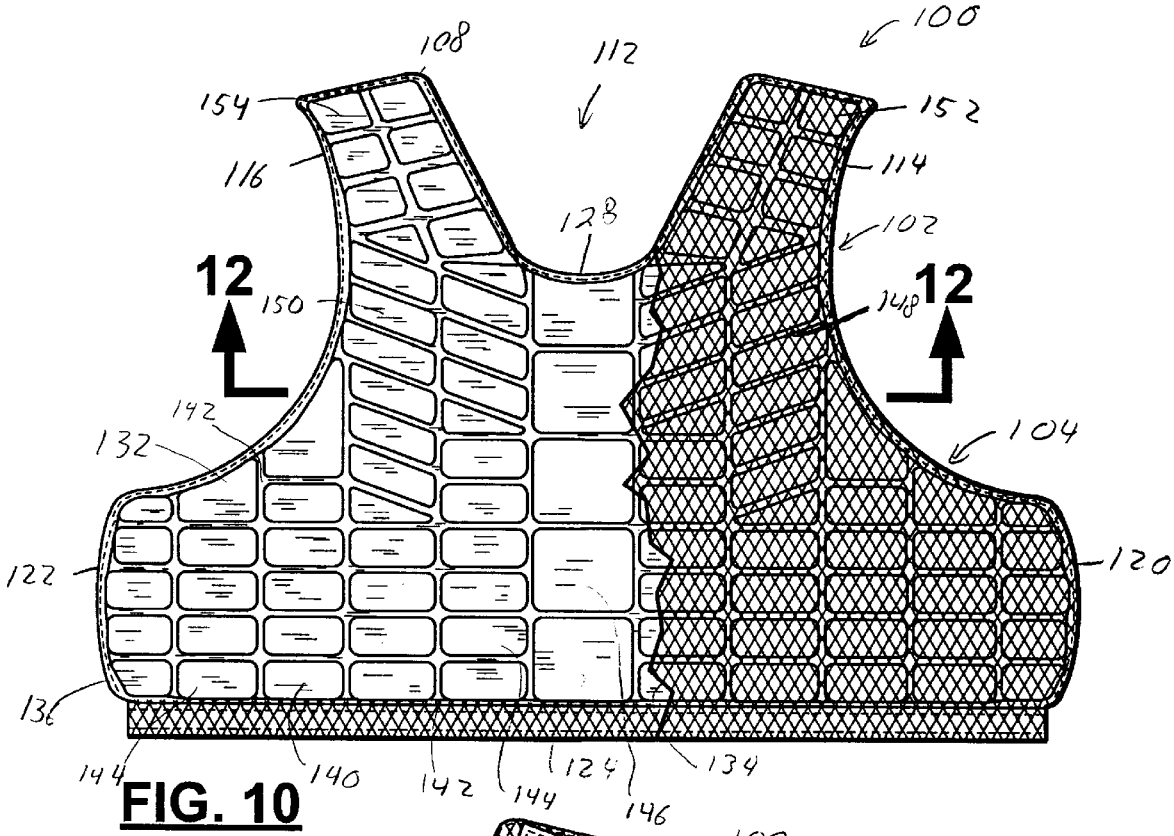
FIG. 10 is an elevational, partial cut away view of an inner side of a front cushioning member constructed in accordance with the present invention (an outer side of the front cushioning member being depicted in FIG. 8).
Figure 12:
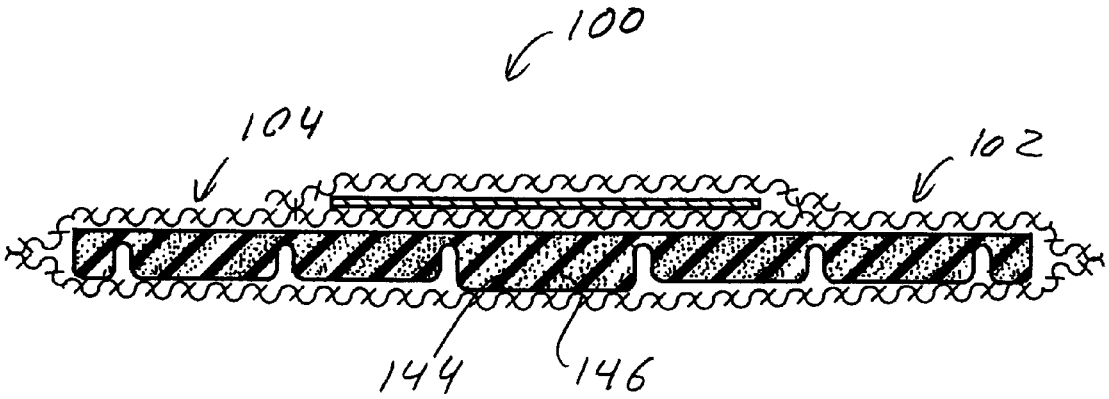
FIG. 12 is a cross-sectional view of a portion of the front cushioning member taken along the lines 12—12 depicted in FIG. 10.

The frontal cushioning assembly 104 is best shown in FIGS. 8, 10 and 12. The frontal cushioning assembly 104 has a top end 108, and a bottom end 110. A substantially U-shaped neck receiving opening 112 is formed through the top end 108 so as to define a first wing portion 114 and a second wing portion 116. The first wing portion 114 and the second wing portion 116 are sized, dimensioned and adapted to be disposed across the shoulders of the individual when at least a portion of the individual's neck is disposed in the neck receiving opening 112. It should be noted that the first wing portion 114 and the second wing portion 116 are shaped and dimensioned to substantially cover the clavicles and shoulders of the individual so as to have a width, which is greater than a width of the seat belts and/or other safety harnesses in a race car to protect the individual's clavicles and shoulders from impact with the seat belt and/or other safety harnesses.

The frontal cushioning assembly 104 is also provided with a first side section 120 and a second side section 122. The first side section 120 and the second side section 122 project outwardly from a medial portion 124 of the frontal cushioning assembly 104. The first side section 120 and the second side section 122 are sized and adapted so as to cover a portion of he individual's upper torso, generally in between the individual's arms and the individual's midriff.

The frontal cushioning assembly 104 is provided with a length 126 (FIG. 8) extending between the lowermost portion of the neck receiving opening 112 and the bottom end 110 thereof. When the frontal cushioning assembly 104 is worn by the individual, a portion 128 of the frontal cushioning assembly 104, which is substantially adjacent the neck receiving opening 112, is disposed adjacent the hollow of the individual's throat, and the frontal cushioning assembly 104 extends downwardly therefrom to the bottom end 110, which is disposed adjacent to the individual's midriff, such that the frontal cushioning assembly 104 effectively covers the individual's chest cavity.

The first side section 120 and the second side section 122 are sized and adapted to extend below the individual's arms to effectively cover the individual's rib cage when the frontal cushioning assembly 104 is being worn by the individual.

The frontal cushioning assembly 104 includes a cushioning member 132 which is formed of a flexible, yet resilient energy absorbing, or dissipating material so as to be comfortable when worn by the individual, yet capable of preventing or reducing injury to the individual when impact is applied thereto. In one embodiment, the cushioning member 132 can be constructed of a closed cell crosslinked polyethylene foam, such as three laminated layers of Voltek Volara, from outside to inside Volara 4E, Volara 6E, Volara 4E. The cushioning member 132 can be provided as a unitary structure, if desired.

The frontal cushioning assembly 104 is provided with an outer shell 134 which is disposed about the cushioning member 132 to substantially encompass the cushioning member 132. The outer shell 134 can be constructed of a mesh-like material defining a plurality of spatially disposed openings to permit air to circulate through the outer shell 134. Stitching 136 can be provided through adjacently disposed portions of the outer shell 134 around the perimeter of the frontal cushioning assembly 104 so as to maintain the outer shell 134 about the cushioning member 132.

The cushioning member 132 has an outer side 138 (as best shown in FIG. 8), and an inner side 140 (as best shown in FIG. 10). The outer side 138 of the cushioning member 132 is constructed to have a smooth texture thereon. In contrast, a plurality of air receiving channels 142 are formed in the inner side 140 of the cushioning member 132 to define a plurality of cushion member ridges 144 on the inner side 140 of the cushioning member 132.

The cushion member ridges 144, and the air receiving channels 142 defined therebetween function to permit air to pass through the air receiving channels 142 to circulate about and cool the portions of the individual covered by the cushioning member 132, and to provide the cushioning member 132 with added flexibility.

The cushion member ridges 144 can be characterized as having a central portion 146, a first medial portion 148, a second medial portion 150, a first strap portion 152 and a second strap portion 154. The central portion 146 is disposed generally centrally in the cushioning member 132, and extends from the lowermost portion of the neck receiving opening 112, to near the bottom end 110 of the frontal cushioning assembly 104. The first medial portion 148, and the second medial portion 150 of the cushion member ridges 144 extend on respective opposite sides of the central portion 146, generally from the lowermost portion of the neck receiving opening 112 toward the bottom end 110 of the frontal cushioning assembly 104. The first strap portion 152 and the second strap portion 154 of the cushion member ridges 144 extend into the respective first and second wing portions 114 and 116 of the frontal cushioning assembly 104.

As best shown in FIG. 10, the cushion member ridges 144 formed in the first and second medial portions 148 and 150 are angled relative to the cushion member ridges 144 formed in the central portion 146 such that the cushion member ridges 144 in the first and second medial portions 148 and 150 permit the cushioning member 132 to readily form about the pectoral regions of the individual when the frontal cushioning assembly 104 is being worn by the individual.

As best shown in FIG. 12, the cushion member ridges 144 in the central portion 146 have a thickness extending between the outer side 138 and the inner side 140 of the cushioning member 132, which is greater than the thickness of the remainder of the cushioning member 132 so that the inner side 140 forms to the contours of the individual's chest while maintaining the outer side 138 of the cushioning member 132 in a substantially planar relationship for a purpose to be described hereinafter.

To enhance the flexibility and comfort of the first and second wing portions 114 and 116 as the first and second wing portions 114 and 116 are disposed about the individual's shoulders, the cushion member ridges 144 in the first and second strap portions 152 and 154, are angled in an opposite direction with respect to the angle of the cushion member ridges 144 in the first and second medial portions 148 and 150.

Formed in the outer shell 134, generally adjacent the outer side 138 of the cushioning member 132, is a pocket 160 adapted to receive a rigid, yet resilient impact receiving member 162 for protecting the individual's chest from impact with the steering wheel of a race car, for example. The impact receiving member 162 can be provided with a generally planar configuration so that the impact receiving member 162 conforms to the contours of the outer side 138 of the cushioning member 132. The impact receiving member 162 can be constructed of a resilient plastic material. A connector assembly 164 is provided adjacent to a mouth 166 of the pocket 160 to permit the impact receiving member 162 to be removably sealed within the pocket 160. The connector assembly 164 can be a VELCRO® brand connector assembly.

Figure 9:
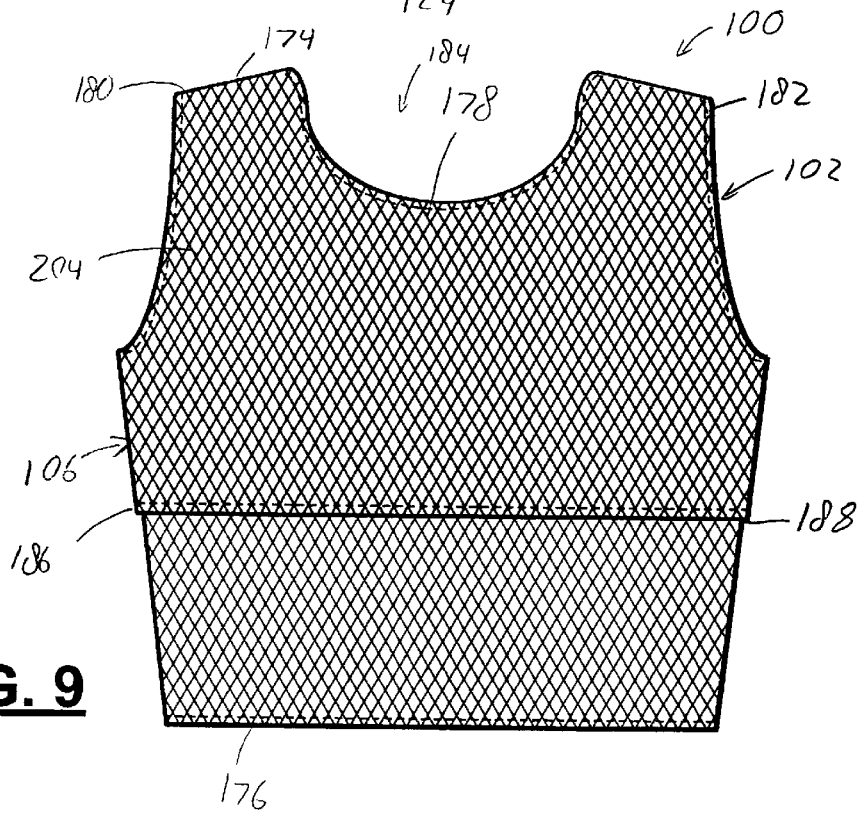
FIG. 9 is a rear elevational view of the vest depicted in FIG. 8.
Figure 11:
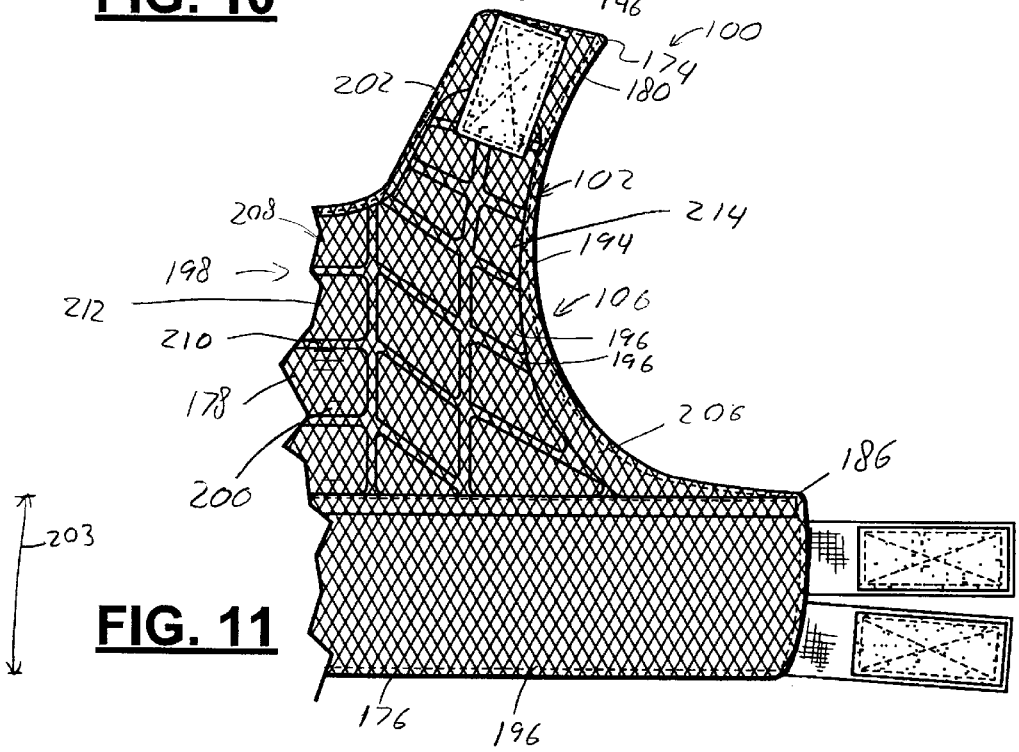
FIG. 11 is a fragmental, elevational view of an inner side of a rear cushioning member constructed in accordance with the present invention (an outer side of the rear cushioning member is depicted in FIG. 9).

Referring now to FIGS. 9 and 11, the rear cushioning assembly 106 will now be described. The rear cushioning assembly 106 is sized, dimensioned and adapted to be disposable about the back of the individual so as to cover the individual's shoulder blades and to prevent or reduce injury thereto upon impact to the rear cushioning assembly 106.

The rear cushioning assembly 106 is provided with a top end 174 and a bottom end 176. The rear cushioning assembly 106 is provided with a central portion 178. A first wing portion 180, and a second wing portion 182 extend upwardly from the central portion 178 so as to define a neck receiving opening 184 positionable about at least a portion of the individual's neck so that the first and second wing portions 180 and 182 are disposable over at least a portion of the individual's shoulders so as to protect the individual's shoulders and clavicles from injury when force is applied to the first and second wing portions 180 and 182. To prevent injury to the individual's shoulder and clavicles from impact with seat belts and/or safety harnesses in a race car, for example, the first and second wing portions 180 and 182 desirably have a width which is greater than the width of the seat belts and/or safety harnesses.

The rear cushioning assembly 106 includes oppositely disposed first and second extension members 186 and 188 extending from the central portion 178. As best shown in FIG. 8, the first and second extension members 186 and 188 are sized and dimensioned so as to be wrapped underneath the individual's arms so that the first and second extension members 186 and 188 overlap over the first side section 120 and the second side section 122 of the frontal cushioning assembly 104. In other words, the first and second extension members 186 and 188 are wrapped underneath the individual's arms so as to be disposable generally adjacent the front of the individual.

The rear cushioning assembly 106 includes an outer shell 194 defining a plurality of spacially disposed openings 196 therein so as to permit air to circulate through the openings 196. The outer shell 194 can be constructed of a mesh-like material, for example. The outer shell 194 defines a pocket 198 adapted to receive a cushioning member 200 therein. Stitching 202 can be provided around the perimeter of the cushioning member 200 to maintain the cushioning member 200 in the outer shell 194. The cushioning member 200 extends downwardly from the top end 174 of the rear cushioning assembly 106, to terminate a distance 203 from the bottom end 176 of the rear cushioning assembly 1015, and above the first and second extension members 186 and 188 so that the cushioning member 200 extends over the individual's shoulders, and the individual's upper back to a location just below the individual's shoulder blades when the rear cushioning assembly 106 is being worn by the individual.

The cushioning member 200 is provided with an outer side 204, and an inner side 206. The cushioning member 200 defines a fairly substantially flat contiguous surface on the outer side 204, and a plurality of spacially disposed cushion member ridges 208 on the inner side 206 thereof. The cushion member ridges 208 define a plurality of air receiving channels 210 therebetween so as to permit air to readily circulate through the openings 196 and the outer shell 194, and into the air receiving channels 210 so as to cool the portions of the individual covered by the cushioning member 200. It should also be noted that the spacially disposed cushion member ridges 208 enhance the inherent flexibility in the cushioning member 200 so as to make the rear cushioning assembly 106 more comfortable to the individual when being worn thereby.

The cushion member ridges 208 can be characterized as having a central portion 212, and a pair of oppositely disposed outer portions 214 disposed on either side of the central portion 212. Although only one half of the rear cushioning assembly 106 is shown in FIG. 11 for purposes of clarity, it should be understood that the rear cushioning assembly 106 is generally symmetrical in configuration.

The cushion member ridges 208 in the outer portion 214 are angled relative to the cushion member ridges 208 in the central portion 212 so as to permit the cushioning member 200 to readily form about the individual's upper back and shoulders.

The vest 100 is further provided with a first connector assembly 220 for connecting the respective first and second wing portions 114 and 116 of the frontal cushioning assembly 104 to the first and second wing portions 180 and 182 of the rear cushioning assembly 106. The vest 100 is also provided with a second connector assembly 224 for connecting the respective first and second side sections 120 and 122 of the frontal cushioning assembly 104 to the first and second extension members 186 and 188 of the rear cushioning assembly 106. The first connection assembly 220 is adapted to permit the amount of overlap between the first and second wing portions 114 and 116 and the respective first and second wing portions 180 and 182 to be adjusted so that the height, and the size of the neck receiving openings 112 and 184 of the vest 100 can be adjusted. In one embodiment, the first connector assembly 220 can be a VELCRO® brand connector assembly disposed on respective portions of the first and second wing portions 114 and 116 and the first and second wing portions 180 and 182 (as shown in FIG. 8).

The second connector assembly 224 is adapted to permit the amount of overlap between the first and second side sections 120 and 122, and the respective first and second extension members 186 and 188 to be adjusted so that the diameter of the vest 100 can be adjusted to fit individuals of various sizes. In one embodiment, the second connector assembly 224 can be a VELCRO® brand connector assembly.

In use, the vest 100 is provided with the first connector assembly 220 connecting the frontal cushioning assembly 104, to the rear cushioning assembly 106 such that the neck receiving openings 112 and 184 are spaced a distance apart to receive the individual's head. Initially, the lower portions of the frontal and rear cushioning assemblies 104 and 106 are not connected by the second connector assembly 224.

The individual's head is disposed through the neck receiving openings 112 and 184 defined by the frontal and rear cushioning assemblies 104 and 106 such that the first and second wing portions 114 and 116 of the frontal cushioning assembly 104, and the first and second wing portions 180 and 182 of the rear cushioning assembly 106 are disposed about the individual's shoulders, the frontal cushioning assembly 104 covers the individual's chest, and the rear cushioning assembly 106 covers the individual's upper back. The first connector assembly 220 is then adjusted so that the frontal and rear cushioning assemblies 104 and 106 are disposed loosely about the individual's neck.

Then, the second connector assembly 224 is utilized to connect the lower ends of the frontal and rear cushioning assemblies 104 and 106 so that the cushioning assembly 102 is disposed snugly about the individual's torso. In this position, the cushioning assembly 102 functions to prevent or reduce injury to the individual from impact applied to the cushioning assembly 102. In the instance when the vest 100 is to be utilized as a race car driver vest, the individual then sits in the seat of the race car, and the seat belts and other safety harnesses are disposed snugly about the individual. The seat belts and other safety harnesses in a race car are well known and no more comments are deemed necessary to teach one of ordinary skill in the art to make or use the seat belts and other safety harnesses.

Thus, it can be seen that the vests 10 and 100, as constructed in accordance with the present invention, serve to prevent or reduce injury to the individual when impact is applied thereto, while being comfortable to wear by the individual. In addition, the vests 10 and 100 serve to cover the portions of the individual which are most likely to be engaged by the seat belts, safety harnesses or molded car seat in a race car to prevent or reduce injury thereto during a race car crash.

Although the vests 10 and 100 have been described herein as to be worn by a race car driver who is to be seated in a molded race car seat and maintained therein by safety harnesses and straps, it should be understood that the vests 10 and 100 of the present invention can be suitable for other uses, such as any sports or leisure activity, which can benefit from chest protection.

Changes may be made in the embodiments of the invention described herein, or in the parts or the elements of the embodiments described herein or in the steps or sequence of steps of the methods described herein. Without departing from the spirit and/or the scope of the invention as defined in the following claims.

What is claimed is:

1. A vest which conforms to a race car seat to be worn by a race car driver who is to be seated in the race car seat during a car race and maintained therein by safety harnesses and straps, comprising:

a cushioning assembly extendable about the chest cavity, collar bones, sternum, shoulder blades, scapula, clavicles and rib area of the race car driver to prevent injury to the race car driver when impact is applied thereto, the cushioning assembly being constructed to permit air to circulate about and cool the portions of the race car driver covered by the cushioning assembly, the cushioning assembly having an outer surface substantially conforming to the shape of the race car driver's body and being formed of a flexible cushioning material so as to conform to the contours of the race car seat and the race car driver wearing the vest, the cushioning assembly extending downwardly from about the hollow of the throat of the race car driver to the midriff of the race car driver in the front and from the nape of the neck of the race car driver to just below the race car driver's shoulder blades in the back whereby the race car driver can assume a seated position in the race car without substantial interference from the cushioning assembly.

2. A vest as defined in claim 1, wherein the cushioning assembly includes:

a frontal cushioning assembly positionable along the chest of the race car driver and having first and second wing portions extendable across the shoulders of the race car driver and first and second side sections extendable underneath the arms of the race car driver and about the race car driver's torso; and a separate rear cushioning assembly positionable about the back of the race car driver so as to cover the race car driver's shoulder blades and having first and second wing portions extendable across the shoulders of the race car driver and first and second extension members extendable along the sides of the race car driver;

a first connector assembly adapted to adjustably connect the respective first and second wing portions of the frontal cushioning assembly to the first and second wing portions of the rear cushioning assembly; and a second connector assembly adapted to adjustable connect the respective first and second side portions of the frontal cushioning assembly to the first and second extension members of the rear cushioning assembly.

3. A vest as defined in claim 1, wherein the cushioning assembly includes an inner side constructed to form to the contours of the pectoral regions of the race car driver's chest.

4. A vest as defined in claim 3, wherein the cushioning assembly is constructed to maintain an outer side of the cushioning assembly, which is located adjacent to the race car driver's chest, in a substantially planar relationship.

5. A vest as defined in claim 1, further comprising:

an impact receiving member being disposed on an outer side of the cushioning assembly, the impact receiving member being constructed of a rigid, yet resilient material and positioned to protect the race car driver's chest from injury resulting from impact to the impact receiving member.

6. A vest as defined in claim 5, wherein the cushioning assembly further comprises:

an outer shell defining a pocket, the pocket being disposed adjacent to the race car drivers chest when the vest is positioned on the race car driver, the pocket being sized and dimensioned to receive the impact receiving member, the pocket defining a mouth to permit the impact receiving member to be disposed within the pocket and the impact receiving member being positioned in the pocket;

a connector assembly provided adjacent to the mouth of the pocket to permit the impact receiving member to be removably sealed within the pocket.

7. A vest as defined in claim 1, wherein the cushioning assembly further comprises:

an outer shell adapted to be disposed adjacent to at least a portion of the race car driver, the outer shell defining a pocket and the outer shell being constructed to permit air to pass through the outer shell and into the pocket; and a resilient cushioning member disposed within the pocket formed by the outer shell.

8. A vest as defined in claim 7, wherein the resilient cushioning member has an inner side adapted to be disposed adjacent to the race car driver, the inner side forming a plurality of cushion member ridges so as to define a plurality of air receiving channels there between.

9. A method for protecting a race car driver, comprising the steps of:

donning a cushioning assembly about the chest cavity, collar bones, sternum, shoulder blades, scapula, clavicles and rib area of the race car driver to prevent injury to the race car driver when impact is applied thereto, the cushioning assembly being constructed to permit air to circulate about and cool portions of the race car driver's body covered by the cushioning assembly, the cushioning assembly having an outer surface substantially conforming to the shape of the race car driver's body and being formed of a flexible cushioning material so as to conform to the contours of the race car driver wearing the vest, the cushioning assembly extending downwardly from about the hollow of the throat of the race car driver to the midriff of the race car driver in the front and from the nape of the neck of the race car driver to just below the race car drivers shoulder blades in the back;

entering the race car and sitting in the race car seat by the race car driver wherein upon sitting in the race car seat the movements of the race car driver are substantially unrestricted such that the flexible cushioning material of the cushioning assembly substantially conforms to the contours of the race car seat; and donning safety harnesses provided in the race car about the race car driver whereby the portions of the race car driver most likely to be engaged by the safety harnesses or the car seat in a race car are covered by the cushioning assembly so as to prevent or reduce injury thereto during a race car crash.

10. A method as defined in claim 9, wherein the cushioning assembly includes a frontal cushioning assembly and a rear cushioning assembly, and wherein the step of disposing the cushioning assembly about the race car driver is further defined as including the steps of:

donning the frontal cushioning assembly about the chest of the race car driver and first and second wing portions thereof about the shoulders of the race car driver and first and second side sections thereof underneath the arms of the race car driver and about the race car driver's torso; and donning a separate rear cushioning assembly about the back of the race car driver so as to cover the race car driver's shoulder blades and first and second wing portions thereof across the shoulders of the race car driver and first and second extension members thereof along the sides of the race car driver;

adjustably connecting the respective first and second wing portions of the frontal cushioning assembly to the first and second wing portions of the rear cushioning assembly; and adjustably connecting the respective first and second side portions of the frontal cushioning assembly to the first and second extension members of the rear cushioning assembly.

11. A method as defined in claim 10, wherein the first and second wing portions of the frontal cushioning assembly have a width exceeding the width of the safety harnesses adapted to be extendable across the race car driver's shoulders.

12. A method as defined in claim 10, wherein the first and second wing portions of the rear cushioning assembly have a width exceeding the width of the safety harnesses adapted to be extendable across the race car driver's shoulders.

13. A method for protecting a race car driver, comprising the steps of donning a cushioning assembly about the chest cavity, collar bones, sternum, shoulder blades, scapula, clavicles and rib area of the race car driver to prevent injury to the race car driver when impact is applied thereto, the cushioning assembly being constructed to permit air to circulate about and cool portions of the race car driver's body covered by the cushioning assembly, the cushioning assembly being formed of a flexible cushioning material so as to conform to the contours of the race car driver wearing the vest;

entering the race car and sitting in the race car seat by the race car driver wherein upon sitting in the race car seat the cushioning assembly substantially conforms to the contours of the race car seat; and extending safety harnesses provided in the race car about the race car driver such that the portions of the race car driver most likely to be engaged by the safety harnesses in the race car are covered by the cushioning assembly so as to prevent or reduce injury thereto during a race car crash.

* * * * *